United States Patent [19]

Marotto

[11] Patent Number: 4,804,216

[45] Date of Patent: Feb. 14, 1989

[54] CONVERTIBLE BACKSET LATCH MECHANISM

[75] Inventor: Robert A. Marotto, Auburn, Ala.

[73] Assignee: Dexter Lock Company, Auburn, Ala.

[21] Appl. No.: 150,869

[22] Filed: Feb. 1, 1988

[51] Int. Cl.[4] ..... E05C 1/16

[52] U.S. Cl. ..... 292/337; 272/1; 272/DIG. 60; 272/169

[58] Field of Search ..... 292/1, DIG. 60, 337, 292/169, 169.21, 169.23, 169.14

[56] References Cited

U.S. PATENT DOCUMENTS

| | | | |
|---|---|---|---|
| 3,790,196 | 2/1974 | Sanders et al. | 292/337 |
| 4,427,224 | 1/1984 | Bergen | 292/1 |
| 4,446,707 | 5/1984 | Mullich et al. | 292/DIG. 60 |
| 4,516,798 | 5/1985 | Bergen | 292/169.13 |
| 4,561,684 | 12/1985 | Marotto | 292/150 |
| 4,564,229 | 1/1986 | Mullich et al. | 292/169 |
| 4,615,549 | 10/1986 | Couture | 292/1 |
| 4,623,174 | 11/1986 | Trull | 292/169 |
| 4,687,239 | 8/1987 | Lin | 292/337 |
| 4,708,379 | 11/1987 | Ching | 292/DIG. 60 |
| 4,750,766 | 1/1988 | Shen | 292/169.14 |

*Primary Examiner*—Richard E. Moore
*Assistant Examiner*—Eric K. Nicholson
*Attorney, Agent, or Firm*—Pennie & Edmonds

[57] ABSTRACT

A backset latch mechanism having a longitudinal housing adjustable from its rearward backset position in which a traverse spindle-driven swivel unit is engageable with a bolt retractor in the housing having transverse rearward lips engaging the swivel unit passing through the housing. The swivel unit is transversely and longitudinally moveable in the housing to permit the unit to pass forwardly in the housing past traverse forward lips and into engagement with such forward lips to thereby accomplish backset adjustment. The swivel unit is movable in opposite directions to place the mechanism in its first backset position.

3 Claims, 4 Drawing Sheets

CONVERTIBLE BACKSET LATCH MECHANISM

BACKGROUND OF THE INVENTION

Prior backset mechanisms have included removable inserts to accomplish backset adjustments (U.S. Pat. No. 4,427,224). Others have used bayonet type adjustment means (U.S. Pat. No. 4,372,594).

SUMMARY OF THE INVENTION

Broadly, the invention comprises a backset latch mechanism adjustable from a rearward position to a forward position or vice versa. A traverse spindle-driven swivel unit is engageable with a bolt retractor through forward and rearward lips on the retractor. The swivel unit is transversely and longitudinally moveable in the housing past forward lips and into engagement with such forward lips and vice versa.

DESCRIPTION OF THE PREFERRED EMBODIMENT

Figure 2A:
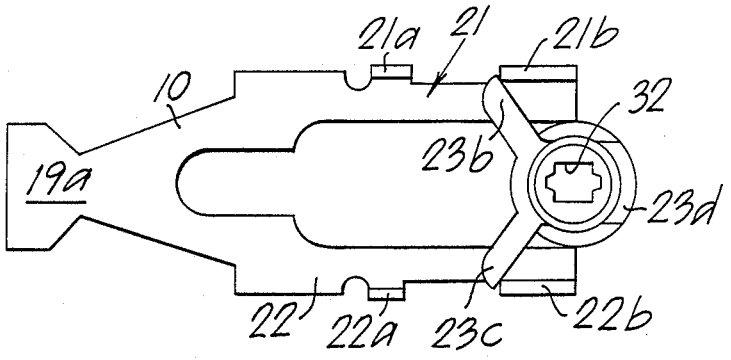
FIG. 2*a* is a side elevational view of the bolt retractor and in the mechanism.
Figure 2B:
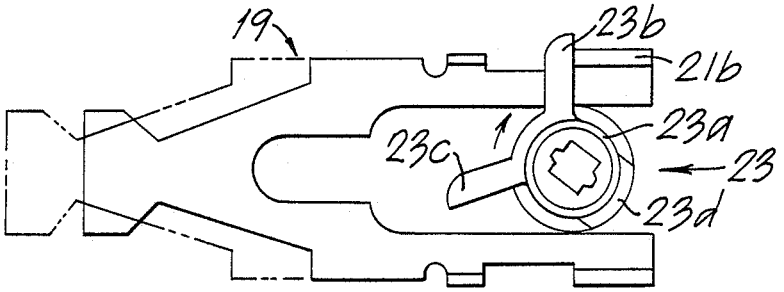
FIG. 2*b* shows the retractor and swivel plate during rotation of the plate clockwise.
Figure 2C:
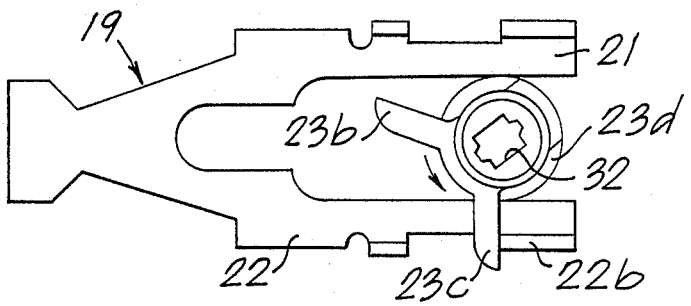
FIG. 2*c* shows the retractor and swivel during counterclockwise rotation.
Figure 3:
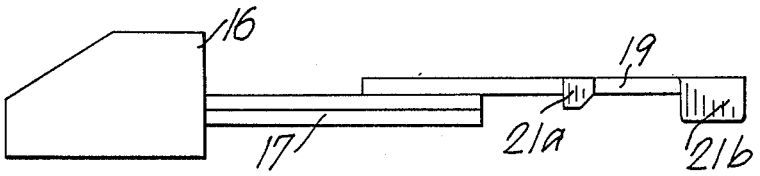
FIG. 3 is a plan view of the retractor, bolt body and bolt.

In FIGS. 1–5, latch mechanism 12 includes flat front plate 10 (partially shown), round front plate 11, casing 9 which in turn includes round casing portion 13 and integrally formed casing frame half plates 14 and 15. Casing frame half plates 14, 15 are parallel and spaced apart. Bolt 16 is connected to bolt body 17 which is slidably connected to bolt retractor 19 (FIG. 3).

Bolt retractor 19 has upper arm 21, lower arm 22 and forward portion 19*a*. Each arm 21, 22 carries forward and rearward swivel plate engageable lips 21*a*, 22*a* and 21*b* , 22*b* respectively. Spindle-operable swivel unit 23 (FIG. 5) includes swivel plate 23*d*, swivel cylindrical retainer body 23*a* and swivel projections 23*b* and 23*c*.

Swivel plate 23*d* is located in swivel slot 23*e* of body 23*a* to cause swivel plate 23 and body 23*a* to rotate as a unit. Cylindrical swivel retainer body 23*a* is rotatable in circular openings 26*a*, 27*a* of slide plates 26 and 27. Slide plates 26 and 27 in turn slide back and forth on housing frame half plates 14, 15 for backset adjustment as hereinafter explained. Slide plates 26, 27 include front arcuate cutout portions 26*b*, 27*b* which are adjustable to align with front and rear half plate openings 14*a*, 14*b* and 15*a*, 15*b* to hold swivel unit 22 against forward movement during spindle operation. Slide plates 26, 27 are held from rotation by upper guide strips 29*a*, 29*b* and lower guide strips 30*a*, 30*b* (see FIG. 9).

Swivel plate 23*d* has a rectangular aperture 32 for receiving the traverse spindle (not shown). When the spindle is rotated clockwise (FIG. 2*a*) swivel plate 23*d* rotates in the same direction to cause retractor !9 to move to the right through sliding engagement of swivel plate upper projection 23*b* against rearward upper half plate lip 21*b*. - Rotation of the spindle in the opposite direction (counterclockwise) also causes retractor 19 to move to the right (as shown in FIG. 2*c*)

Figure 1:
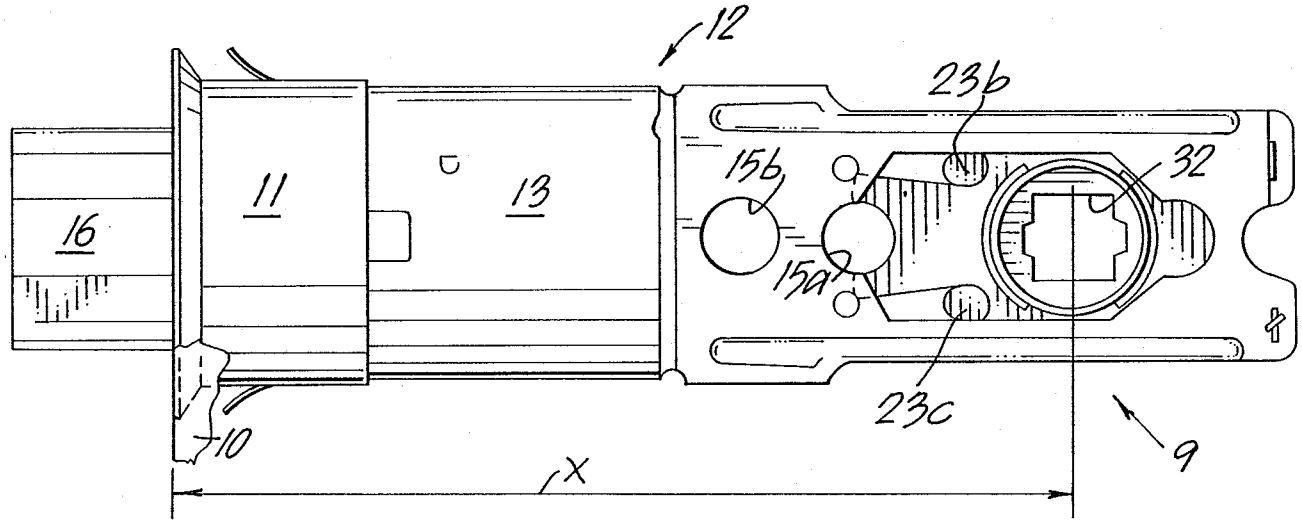
FIG. 1 is a side elevational view of the backset latch mechanism in a $2\frac{3}{4}''$ backset position.
Figure 4:
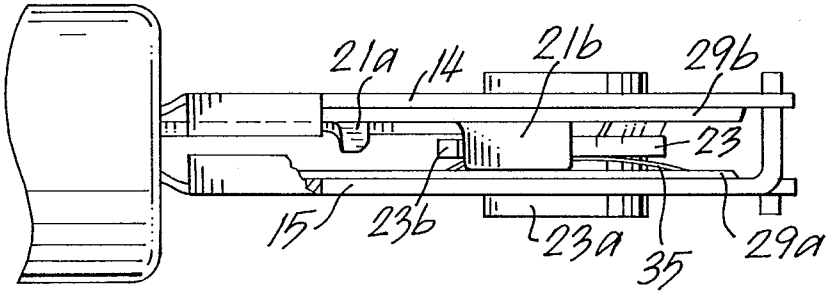
FIG. 4 is a partial top view of the mechanism of FIG. 1.

Turning in particular to FIG. 1, the latch mechanism 12 is shown in this view in its $2\frac{3}{4}''$ (distance X) backset position. As installed, a bolt or screw would be inserted through frame half plate 15*a*, 15*b*, holes and slide plate notches 26*b*, 27*b* to prevent forward movement of slide plates 26, 27. In FIG. 4, swivel plate 23*d* is shown in its rest position with projections 23*b* (and 23*c* not shown) engaging upper rearward lip 21*b* (and lower lip 22*b* (not shown) (see also FIG. 2*a*). Rearward lips 21*b*, 22*b* extend laterally substantially the entire distance from casing frame half plate 14 to spaced-apart half plate 15 while forward lips 21*a* 22*a* extend only about one-half such lateral distance to permit clearance for projections 23*b*, 23*c* of plate 23*d* to pass during backset change. Spring 35 urges swivel plate 23*d* against spacer ring 34 and plate 14 thus maintaining plate 23 centered and a specified distance from half plate 15.

Figure 6:
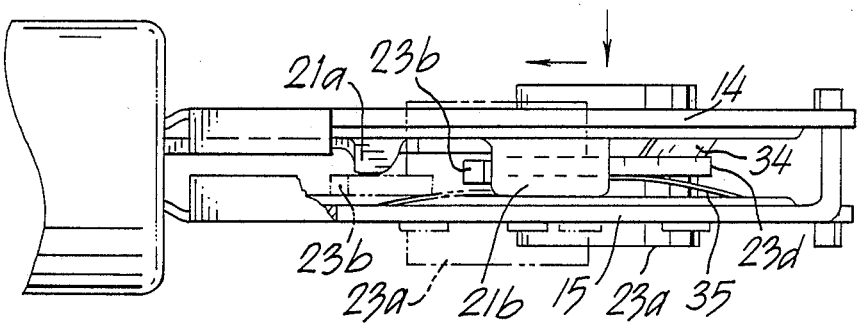
FIG. 6 is a plan view of the mechanism showing transverse longitudinal translation (see arrows) of the swivel to accomplish backset change.
Figure 7:
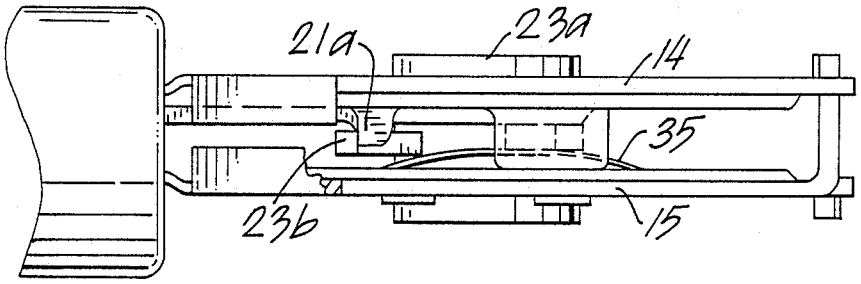
FIG. 7 is a plan view of the mechanism in its $2\frac{7}{8}''$ backset position.
Figure 8:
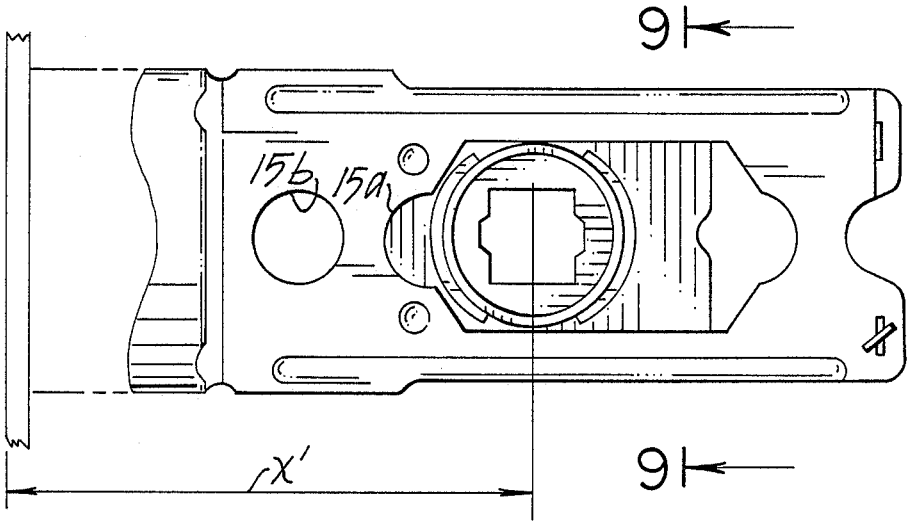
FIG. 8 is a side elevational view of FIG. 7.

In FIG. 6, swivel unit 23 is shown being moved from its $2\frac{3}{4}''$ position (solid line) to a transition position (dot dashed lines). To accomplish backset adjustment, the mechanism 12 need only be held in the adjuster's hand and the swivel retainer body 23*a* urged downwardly (as shown by the arrow in FIG. 6) to overcome spring 35 until swivel plate 23*d* flattens spring 35 against plate 15. Once the swivel retainer body 23*a* is in this position swivel plate projections 23*b* (and 23*c*) can be moved to the left (dashed dot lines) clearing forward lips 21*a*, 22*a*. Upon completion of leftward movement of unit 22 past lips 21*a*, 22*a*, the swivel body 23*a* is released and allowed to be centered by spring 35 (see FIGS. 7 and 8). Distance X′ represents the forward backset distance.

Figure 9:
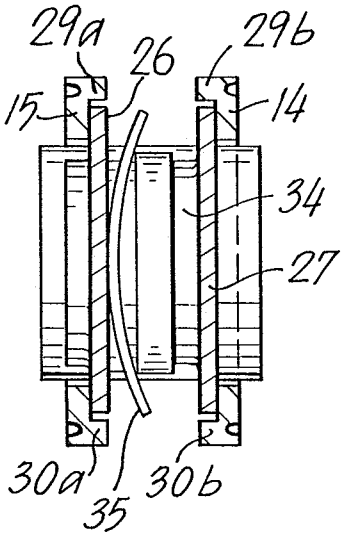
FIG. 9 is a sectional view along lines 9—9 of FIG. 8.
Figure 5:
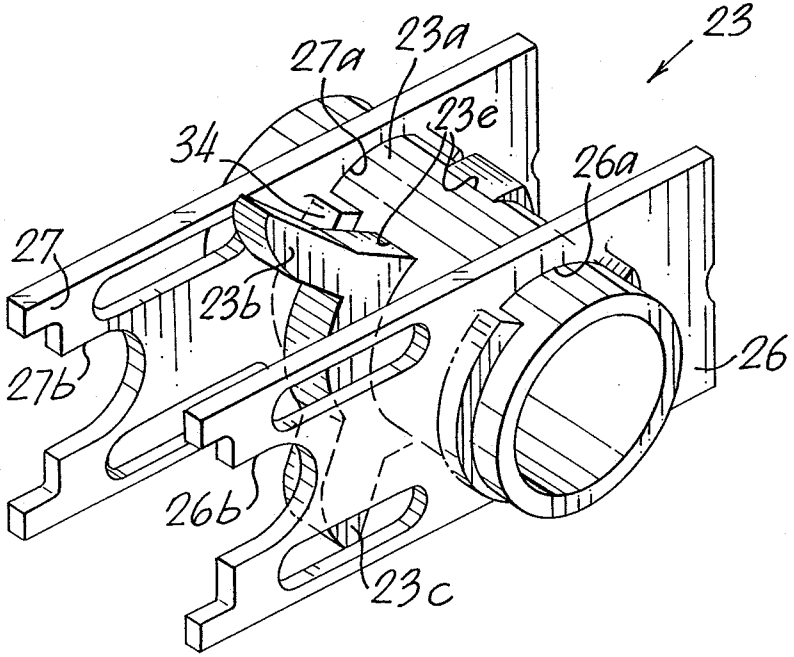
FIG. 5 is a perspective view of the swivel unit, its slide plates, swivel body and the swivel plate.

FIG. 9 shows nesting of slide plates between guide strips 29*a*, 30*a* and 29*b*, 30*b* and the urging of slide plates 26, 27 plates against the inside surfaces of half plates 14, 15 through action of the spring.

I claim:

1. In an adjustable backset latch mechanism having a stationary housing, a bolt movable to a closed position in the housing, a translatable bolt retractor connected to the bolt for moving the bolt to an open position and a transverse spindle insertable through the housing rotatable to translate the bolt retractor, the improvement comprising (a) a housing section having parallel spaced-apart plate walls and a retractor housed between the walls with such retractor having upper and lower forward lips and upper and lower rearward lips;

(b) a swivel unit turnable by such spindle and mounted for sliding movement in the housing section between a forward position and a rearward position, such swivel unit in turn comprising (i) slide means for sliding engagement with a plate wall of the housing section;

(ii) means for securing the slide means to the plate wall in a forward position and means for securing it in a rearward position;

(iii) a swivel plate projection means normally positioned between the housing section plate walls such swivel plate means mounted on the swivel unit for engagement with the bolt retractor when the spindle is turned; and (c) distortable sprinq means urging the swivel unit to its normal-at rest position between the plate walls with such spring means capable of being distorted to move the swivel unit laterally toward a plate wall to permit translation of the swivel unit past upper and lower forward retractor lips whereby upon restoration of such spring means to normalcy the swivel unit is placed in a operable forward backset position.

2. The adjustable backset latch mechanism of claim 1 in which the swivel plate projection means is centered between housing section plate walls in its at rest position.

3. The adjustable backset latch mechanism of claim 1 in which the bolt and the swivel unit are adjustable, one with respect to the other to permit backset adjustment.

* * * * *